US010329133B2

(12) United States Patent
Zerilli

(10) Patent No.: US 10,329,133 B2
(45) Date of Patent: Jun. 25, 2019

(54) AUTOMATIC DISPENSER FOR PREPARING AND DISPENSING A LIQUID FOOD MIXTURE

(71) Applicant: ZERICA S.r.l., Palermo (IT)

(72) Inventor: Marco Zerilli, Palermo (IT)

(73) Assignee: ZERICA S.R.L., Palermo (IT)

( * ) Notice: Subject to any disclaimer, the term of this patent is extended or adjusted under 35 U.S.C. 154(b) by 0 days.

(21) Appl. No.: 15/579,846

(22) PCT Filed: Mar. 21, 2016

(86) PCT No.: PCT/IB2016/051578
§ 371 (c)(1),
(2) Date: Dec. 5, 2017

(87) PCT Pub. No.: WO2016/198966
PCT Pub. Date: Dec. 15, 2016

(65) Prior Publication Data

US 2018/0155177 A1 Jun. 7, 2018

(30) Foreign Application Priority Data

Jun. 10, 2015 (IT) ..... 10 2015 000022168

(51) Int. Cl.
*B67D 1/10* (2006.01)
*B67D 1/00* (2006.01)
*B67D 1/08* (2006.01)

(52) U.S. Cl.
CPC ..... *B67D 1/0017* (2013.01); *B67D 1/0043* (2013.01); *B67D 1/0858* (2013.01); *B67D 1/10* (2013.01); *B67D 1/105* (2013.01)

(58) Field of Classification Search
CPC .. B67D 1/0017; B67D 1/0043; B67D 1/0858; B67D 1/10; B67D 1/105
(Continued)

(56) References Cited

U.S. PATENT DOCUMENTS 3,310,203 A * 3/1967 McCann ..... B67D 1/0043 137/468
3,643,688 A 2/1972 Meinert
(Continued)

FOREIGN PATENT DOCUMENTS

DE 15 32 658 A1 3/1970
GB 904 380 A 8/1962

*Primary Examiner* — Patrick M. Buechner
*Assistant Examiner* — Michael J. Melaragno
(74) *Attorney, Agent, or Firm* — R. Neil Sudol; Henry D. Coleman

(57) ABSTRACT

Automatic dispenser for preparing and dispensing a liquid food mixture includes a food concentrate tank, a pipeline with a first conduit having a food liquid inlet and a first food liquid outlet, a second conduct having a food concentrate inlet in fluid communication with the food concentrate tank, and a food concentrate outlet. A flow rate stabilizer is arranged along the first conduit. A self-priming mixing pump has an inlet in fluid communication with the first food liquid outlet of the first conduit and with the food concentrate outlet of the second conduct (5). The dispenser has a liquid food mixture outlet. The self-priming mixing pump is configured to suction the food concentrate from the food concentrate tank, creating a depression inside the self-priming mixing pump so as to mix therein the food concentrate and the food liquid, obtaining a liquid food mixture. The liquid food mixture has a pressurized outflow from the liquid food mixture outlet.

7 Claims, 4 Drawing Sheets

(58) Field of Classification Search
USPC ..... 222/145.1
See application file for complete search history.

(56) References Cited

U.S. PATENT DOCUMENTS

| | | | | |
|---|---|---|---|---|
| 5,137,061 | A * | 8/1992 | Deininger | B67D 1/10 141/18 |
| 6,276,150 | B1 * | 8/2001 | Nelson | B67D 1/0081 62/177 |
| 7,784,205 | B1 * | 8/2010 | Baron | G09F 13/04 222/129.1 |
| 7,918,156 | B2 * | 4/2011 | Greenwald | A47J 31/56 222/129.1 |
| 9,938,700 | B2 * | 4/2018 | Shaw | E03C 1/02 |
| 2005/0133531 | A1 * | 6/2005 | Crisp, III | B67D 1/0021 222/129.1 |
| 2006/0157505 | A1 * | 7/2006 | Crisp, III | B67D 1/0021 222/129.1 |
| 2007/0164046 | A1 | 7/2007 | Nighy | |
| 2012/0228328 | A1 * | 9/2012 | Ryan | B01F 7/00216 222/129.4 |
| 2012/0230148 | A1 * | 9/2012 | van Opstal | B01F 7/00216 366/167.1 |
| 2013/0062366 | A1 * | 3/2013 | Tansey | A47J 31/44 222/102 |
| 2014/0053911 | A1 * | 2/2014 | Shaw | E03C 1/02 137/3 |
| 2015/0197416 | A1 * | 7/2015 | Hoover | B67D 1/0034 222/1 |
| 2016/0318748 | A1 * | 11/2016 | Ryan | B01F 7/00216 |

* cited by examiner

AUTOMATIC DISPENSER FOR PREPARING AND DISPENSING A LIQUID FOOD MIXTURE

FIELD OF THE INVENTION

The present invention is part of the technical field related to preparing and dispensing liquid food mixtures. Particularly, the present invention refers to an automatic dispenser for preparing and dispensing a liquid food mixture.

DESCRIPTION OF THE PRIOR ART

A liquid food mixture is a food beverage obtained by mixing a food liquid (for example, water) and a food concentrate. The latter is a viscous food product (such as for example, fruit based food concentrates, tomato concentrate or condensed milk) from which the water content has been reduced in order to obtain a richer product in dry matter. A liquid food mixture can be, for example, an orange juice obtained by mixing water and an orange concentrate.

It is known an automatic dispenser for preparing and dispensing a liquid food mixture. That automatic dispenser is used, for example, in the hotels during breakfast for preparing and dispensing a fruit juice.

Referring to FIG. 1, there is shown an automatic dispenser (100) of a known type. It comprises a food concentrate tank (2) and a pipeline (3) which in turn comprises: a first conduit (4) having a food liquid inlet (4*a*) and a food liquid outlet (4*b*); a second conduct (5) having a food concentrate inlet (5*a*) which is in fluid communication with the food concentrate tank (2) and a food concentrate outlet (5*b*).

Moreover, the automatic dispenser (100) comprises a mixing chamber (20) which has: a first inlet (21) which is in fluid communication with the food liquid outlet (4*b*) of the first conduit (4); a second inlet (22) which is in fluid communication with the food concentrate outlet (5*b*) of the second conduct (5); a liquid food mixture outlet (23) through which the liquid food mixture is dispensed by means of a dispensing nozzle (70). Moreover, a spiral-shaped rotatable element (24) is arranged inside the mixing chamber (2) in order to mix the food liquid and the food concentrate.

In order to transport the food concentrate from the food concentrate tank (2) to the mixing chamber (20), the automatic dispenser (100) comprises a peristaltic pump (60) arranged along the second conduct (5). On the contrary, in order to transport the food liquid to the mixing chamber (20), for example the first conduit can be connected to a water supply system (in that case, the food liquid is water and it is provided under pressure).

The known automatic dispenser (100) also needs that a dosed quantity of food liquid exits from the first conduit (4). To that purpose, the automatic dispenser (100) comprises a flow rate measurement device (25) arranged at the food liquid outlet (4*b*) (alternatively, a dosing chamber could be provided).

The making of a liquid food mixture with the known automatic dispenser (100) contemplates the following steps: inputting the dosed quantity of food liquid and food concentrate in the mixing chamber (20); rotatably activating the rotatable element (24) determining the mechanical mixing of the dosed quantity of food liquid and food concentrate; dispensing by gravity, and thus very slowly, the liquid food mixture from the mixing chamber (20) by means of the dispensing nozzle (70).

Said mechanical mixing of the food liquid and food concentrate is performed inside the mixing chamber (20) at atmospheric pressure. Therefore, this could cause the oxidation of the food concentrate and/or the food liquid.

Moreover, a food concentrate has a certain viscosity: consequently, a food concentrate tends to adhere to the components of the automatic dispenser, which are exposed to it determining food concentrate residuals on the walls of said components. Particularly, the quantity of food concentrate adhering to the components of the automatic dispenser increases as much as the viscosity of the food concentrate increases. For that reason, in order to comply with the hygiene regulations and to maintain the automatic dispenser in good hygienic and operating conditions, it is necessary to repeatedly clean the automatic dispenser, both when it is desired to change the kind of food concentrate and periodically in order to guarantee complying with the hygiene regulations.

However, the cleaning of the known automatic dispenser (100) requires disassembling the automatic dispenser (100): particularly, it is necessary to disassemble the peristaltic pump (60), the mixing chamber (20), the rotatable element (24) arranged inside the mixing chamber (20) and the dispensing nozzle (70). It is clear how such a maintenance operation is time critical.

Moreover, also in light that the known automatic dispenser (100) has a high number of components, the maintenance operation must be performed by a qualified person who is able to disassemble and assemble again the components of the known automatic dispenser (100); this causes an increase in the costs.

SUMMARY OF THE INVENTION

In light of the above, the object of the present invention is to overcome the above-mentioned drawbacks.

The above-mentioned object is obtained by means of an automatic dispenser for preparing and dispensing a liquid food mixture according to claim 1.

First, thanks to the action of the self-priming mixing pump, the proposed automatic dispenser allows dispensing the liquid food mixture under pressure (differently from the known automatic dispenser exclusively allowing dispensing the liquid food mixture by gravity). Consequently, the proposed automatic dispenser allows dispensing the liquid food mixture more quickly.

Moreover, since the proposed automatic dispenser provides that the mixing of food concentrate and food liquid occur inside the self-priming mixing pump in which a depression has been created, a possible oxidation of the food concentrate and/or food liquid is avoided. Advantageously, therefore, the proposed automatic dispenser can be used in any environment because the food liquid and the food concentrate do not contact the outside.

A further advantage of the proposed automatic dispenser is that the maintenance is extremely simple, particularly much simpler than the one of the known automatic dispenser (100) (the latter needs to be disassembled). Actually, thanks to the self-priming mixing pump and because it has a reduced number of components, the proposed automatic dispenser can be cleaned simply by starting the water circulation inside the automatic dispenser after disconnecting the food concentrate tank from the second conduct. Consequently, the proposed automatic dispenser is less expensive than the known one in both economical terms and time terms.

Moreover, differently from the known automatic dispenser (100), the proposed automatic dispenser does not provide for any peristaltic pump along the second conduct, namely along the conduit connecting the food concentrate tank to the self-priming mixing pump: in that way it is possible to reduce the dimensions of the second conduct and, consequently, to reduce the cleaning times of the second conduct and the quantity of food concentrate which can adhere to its walls.

BRIEF DESCRIPTION OF THE DRAWINGS

Specific embodiments of the invention will be described in the following of the present dissertation, according to what reported in the claims and with the help of the attached drawings, where:

DESCRIPTION OF PREFERRED EMBODIMENTS

Referring to FIGS. 2-5, with (1) it is indicated an automatic dispenser for preparing and dispensing a liquid food mixture, which is the object of the present invention.

Figure 2:
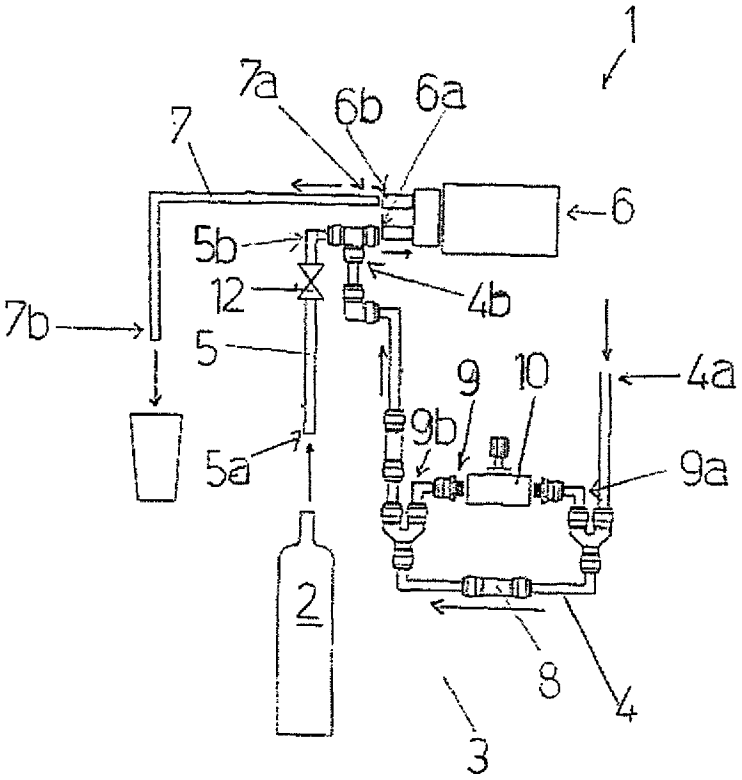
FIGS. 2-5 schematically show different embodiments of an automatic dispenser being object of the invention.
Figure 1:
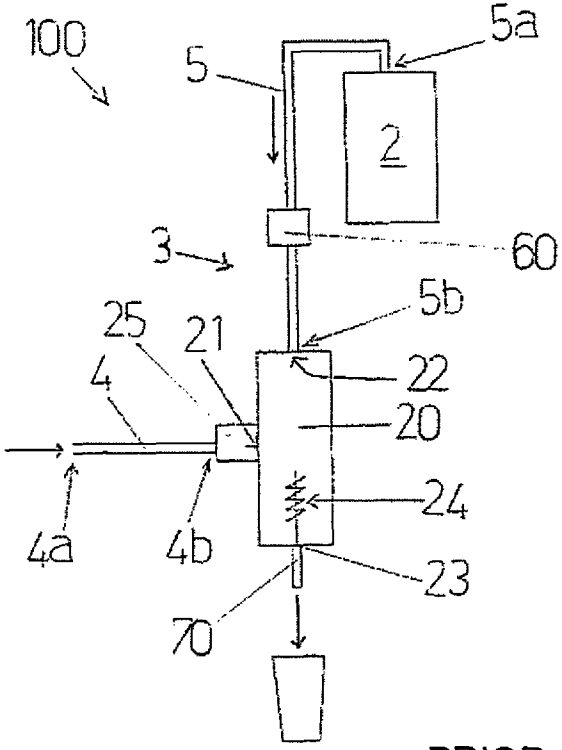
PRIOR ART FIG1
FIG. 1 schematically shows an automatic dispenser of a known type.
Figure 4:
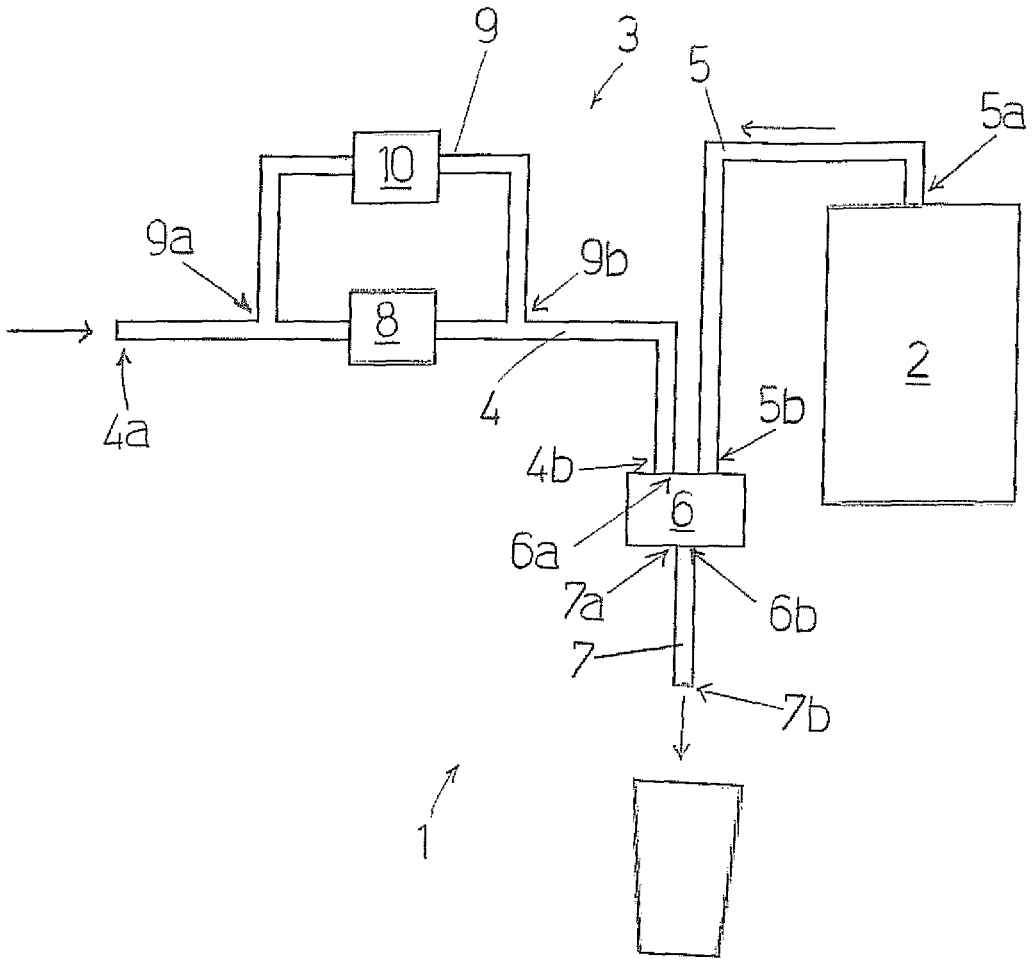

Particularly referring to FIGS. 2 and 4, the proposed automatic dispenser (1) comprises: a food concentrate tank (2); a pipeline (3) which comprises a first conduit (4) comprising a food liquid inlet (4*a*) and a first food liquid outlet (4*b*) and a second conduct (5) comprising a food concentrate inlet (5*a*), which is in fluid communication with the food concentrate tank (2), and a food concentrate outlet (5*b*); flow rate stabilization means (8) arranged along the first conduit (4); a self-priming mixing pump (6) comprising an inlet (6*a*), which is in fluid communication with the first food liquid outlet (4*b*) of the first conduit (4) and with the food concentrate outlet (5*b*) of the second conduct (5), and a liquid food mixture outlet (6*b*).

The self-priming mixing pump (6) is designed for: suctioning the food concentrate from the food concentrate tank (2); creating a depression inside the self-priming mixing pump (6) which is such as to mix, inside the same self-priming mixing pump (6), the food concentrate and the food liquid obtaining a liquid food mixture; allowing the pressurized outflow of the liquid food mixture from the liquid food mixture outlet (6*b*).

Therefore, the liquid food mixture is a liquid food product obtained by mixing a food liquid with a food concentrate. Preferably, the food liquid is water. Alternatively, the food liquid could be, for example, an alcoholic product. On the contrary, the food concentrate is a viscous food product such as for example a fruit based concentrate or a tomato concentrate or condensed milk. Preferably, the food concentrate is a fruit based concentrate.

The flow rate stabilization means (8) are designed in order to ensure that a certain quantity of food liquid is provided to the self-priming mixing pump (6). Preferably, the flow rate stabilization means (8) are a flow limiter (FIGS. 2 and 3).

For example, assuming to have a first food concentrate (for example, a strawberry concentrate) having a given viscosity in the food concentrate tank (2), the flow rate stabilization means (8) will be properly designed depending on the viscosity of the first food concentrate in order to ensure that the self-priming mixing pump (6) receives at its inlet the right quantity of first food concentrate and the right quantity of food liquid.

It is understood that in case the food concentrate tank (2) contains a second food concentrate (for example, an orange concentrate) having a given viscosity, for example higher than the viscosity of the first food concentrate, it will be necessary to provide for flow rate stabilization means (8) being properly designed depending on the viscosity of said second food concentrate in order to ensure that the self-priming mixing pump (6) receives at its inlet the right quantity of second food concentrate and the right quantity of food liquid.

Figure 3:
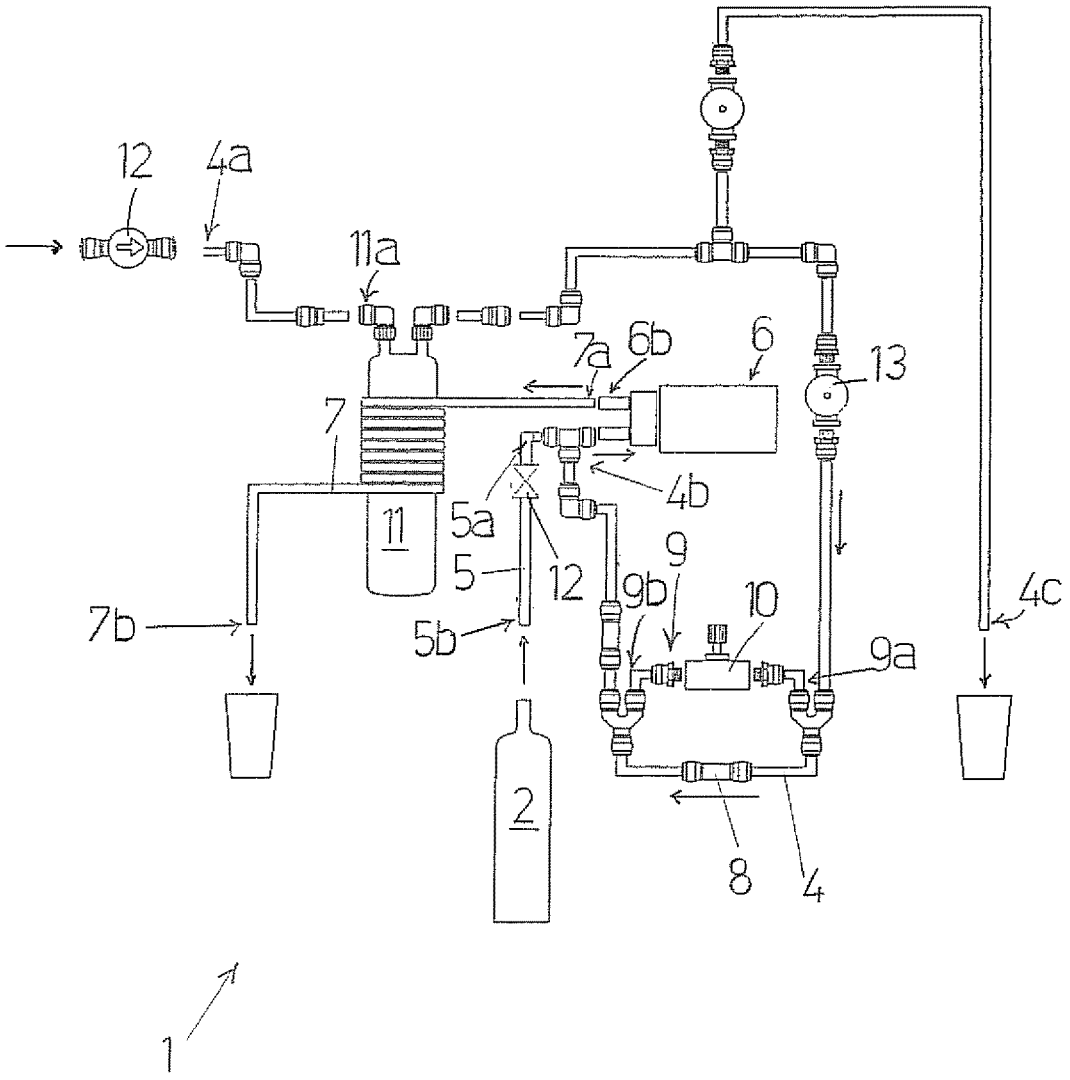

Preferably, the pipeline (3) comprises a third conduit (7) comprising a liquid food mixture inlet (7*a*), which is in fluid communication with the liquid food mixture outlet (6*b*) of the self-priming mixing pump (6), and a liquid food mixture outlet (7*b*) (FIG. 3).

In that embodiment, the automatic dispenser (1) can comprise a refrigerating circuit (not shown) which comprises an evaporator arranged in order to mutually exchange heat with the third conduit (7).

Advantageously, the liquid food mixture is refrigerated and is dispensed at a preferred temperature (for example, it is possible to set a preferred dispensing temperature of the liquid food mixture between 3° C. and 5° C.).

The evaporator could be arranged in order to mutually exchange heat also with the first conduit (4).

Beside the evaporator, the refrigerating circuit can comprise: a refrigerating compressor connected to the evaporator; a refrigerating condenser connected to the refrigerating compressor and the evaporator; and a fan in order to act on the refrigerating condenser.

Figure 5:
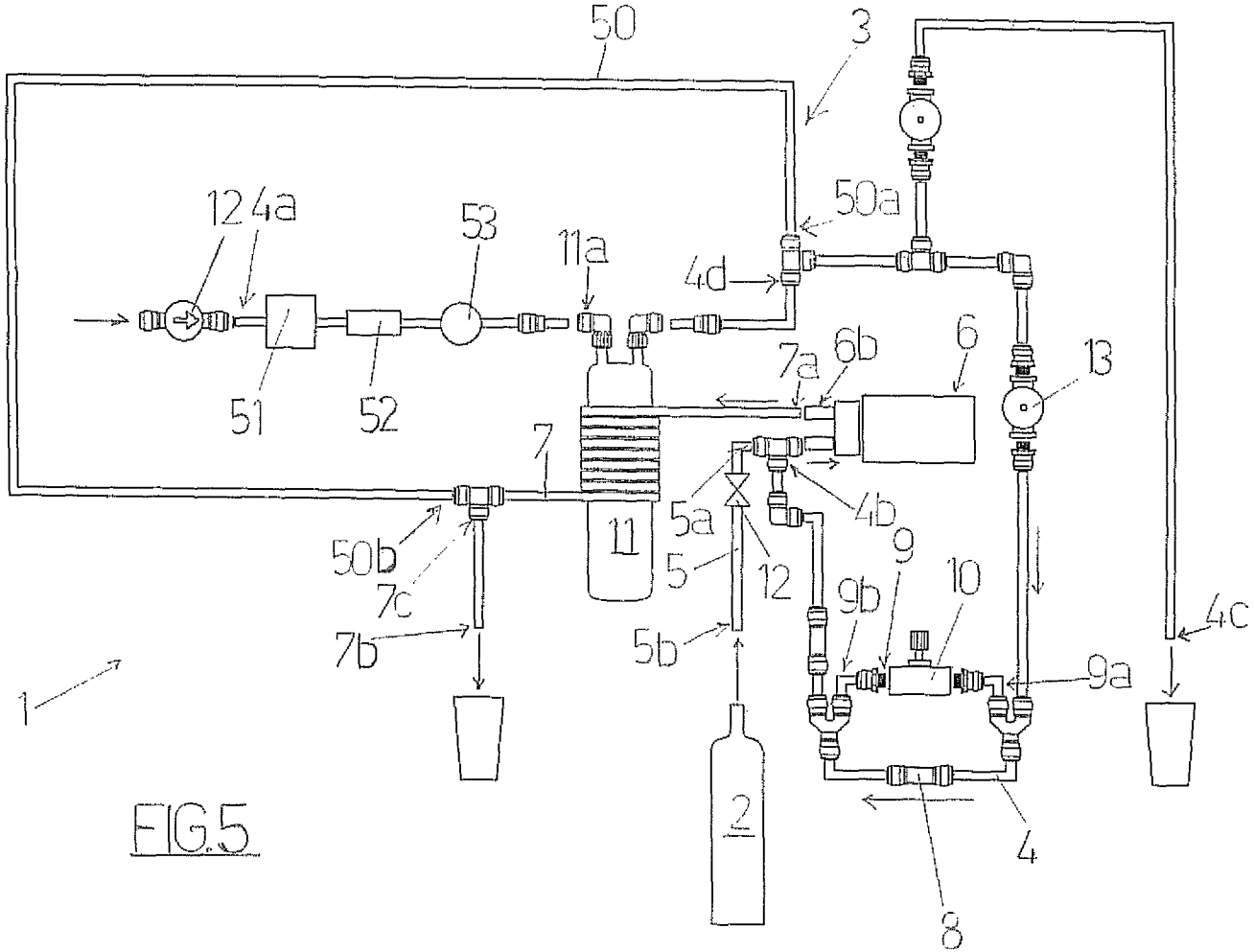

Preferably, with reference to FIG. 5, the first conduit (4) comprises a second food liquid outlet (4*d*). Moreover, the pipeline (3) can comprise a fifth conduit (50) comprising a food liquid inlet (50*a*), which is in fluid communication with the second food liquid outlet (4*d*) of the first conduit (4), and a food liquid outlet (50*b*). The third conduit (7) can also comprise a food liquid inlet (7*c*) which is arranged between the relative liquid food mixture inlet (7*a*) and the relative liquid food mixture outlet (7*b*), which food liquid inlet (7*c*) of the third conduit is in fluid communication with the food liquid outlet (50*b*) of the fifth conduit (50) in order to expedite the outflow of the liquid food mixture from the liquid food mixture outlet (7*b*) of the third conduit (7).

Advantageously, the outflow of the liquid food mixture from the automatic dispenser (1) is facilitated.

Further referring to FIG. 5, the automatic dispenser (1) can comprise a pump (51) arranged along the first conduit (4) upstream of the second food liquid outlet (4*d*). The automatic dispenser (1) can also comprise a flow rate stabilizer (52) arranged along the first conduit (4), upstream of the second food liquid outlet (4*d*) (preferably downstream of the pump (51)). Moreover, the automatic dispenser (1) can comprise a valve (53) (for example, a solenoid valve) arranged along the first conduit (4), upstream of the second food liquid outlet (4*d*) (preferably, downstream of the flow rate stabilizer (52)).

Preferably, the automatic dispenser (1) comprises a food liquid tank (11) which is in fluid communication with the food liquid inlet (4*a*) of the first conduit (4) (FIG. 3). In that case, the evaporator can be arranged in order to mutually exchange heat also with the food liquid tank (11).

Advantageously, by keeping the food liquid at the same temperature of the preferred dispensing temperature of the liquid food mixture it will be necessary less thermal exchange between the evaporator and the third conduit (7) in order to bring the liquid food mixture to the preferred dispensing temperature.

Usually, the food concentrate tank (2) is not refrigerated. Alternatively, it could be refrigerated too.

Preferably, the pipeline (3) comprises a fourth conduit (9) comprising a food liquid inlet (9*a*), which is in fluid communication with the first conduit (4) upstream of the flow rate stabilization means (8), and a food liquid outlet (9*b*), which is in fluid communication with the first conduit (4) downstream of the flow rate stabilization means (8). In that embodiment, the automatic dispenser (1) can comprise flow rate adjusting means (10) which are arranged along the fourth conduit (9) and which are actuatable to adjust the flow rate of the food liquid exiting the first conduit (4).

Advantageously, the flow rate adjusting means (10) allow quickly and easily adapting the automatic dispenser (1) to use food concentrates having different viscosities.

Actually, in case neither the fourth conduit (9) nor the flow rate adjusting means (10) are provided, the automatic dispenser (1) is designed in order to work with a specific food concentrate: the flow rate stabilization means (8) are designed based on the viscosity of the food concentrate. In that case, if it were desired to change food concentrate (with a food concentrate having a different viscosity) it would be necessary to design the flow rate stabilization means (8) again.

On the contrary, using the fourth conduit (9) and the flow rate adjusting means (10) allows adapting the use of the automatic dispenser (1) to any food concentrate by means of the adjustment of the flow rate adjusting means (10) alone. In that embodiment, the flow rate stabilization means (8) ensure that a minimum quantity of food liquid is received at the inlet of the self-priming mixing pump (6).

The flow rate adjusting means (10) are arranged in parallel with respect to the flow rate stabilization means (8) (FIGS. 2-4).

The flow rate adjusting means (10) can be movable between an extreme closure configuration, wherein the flow rate of the food liquid exiting the fourth conduit (9) is at a minimum (i.e. equal to the quantity of the food liquid passing through the flow rate stabilization means (8)), and an extreme opening configuration, wherein the flow rate of the food liquid exiting the fourth conduit (9) is at a maximum.

For example, presuming to have a food concentrate with low viscosity, it will be enough a reduced quantity of food liquid in order to obtain the liquid food mixture: consequently, the flow rate adjusting means (10) will be in the closure configuration (or in an intermediate configuration between the closure one and the opening one) in order to allow a reduced quantity of food liquid to exit from the first conduit (4). On the contrary, supposing to have a food concentrate with high viscosity, it will be necessary a high quantity of food liquid in order to obtain the liquid food mixture: consequently, the flow rate adjusting means (10) will be in the opening configuration (or in an intermediate configuration between the closure one and the opening one) in order to allow a high quantity of food liquid to exit from the first conduit (4).

The flow rate adjusting means (10) can comprise a valve. Simply by adjusting said valve, it will be possible to adjust the flow rate of food liquid exiting the first conduit (4).

Preferably, the self-priming mixing pump (6) is a self-priming pump with rotating compartments. Advantageously, that pump is available on the market at reduced costs.

Preferably, the food liquid inlet (4*a*) of the first conduit (4) is in fluid communication with a water supply system.

Particularly, the food liquid inlet (4*a*) of the first conduit (4) can be directly connected to the water supply system: in that case, the circulation of the food liquid in the first conduit (4) is allowed by the pressure of the water supply system itself.

In that embodiment, the automatic dispenser (1) can comprise a valve (13) (for example, a solenoid valve) arranged along the first conduit (FIG. 3). That valve (13) is actuatable between an open position and a closed position synchronously with the self-priming mixing pump (6): when the self-priming mixing pump (6) is suctioning, then the valve (13) is in the open configuration else it is in the closed configuration.

Alternatively, the automatic dispenser (1) can comprise a food liquid tank (11), which is in fluid communication with the food liquid inlet (4*a*) of the first conduit (4) and which has a food liquid inlet (11*a*) being connectable to a water supply system, whose pressure facilitates the circulation of the food liquid in the first conduit (4). Also in that case, the automatic dispenser (1) can comprise the valve (13) arranged along the first conduit (FIG. 3).

Alternatively, for example in case the food liquid tank (11) is manually filled, the automatic dispenser can comprise pumping means in order to facilitate the circulation of the food liquid in the first conduit (4). In that case, the valve (13) is not necessary.

Preferably, the automatic dispenser (1) can comprise a filter (12) (for example, a dechlorinating filter) arranged upstream of the food liquid inlet (4*a*) of the first conduit (4). In case the automatic dispenser (1) comprises the food liquid tank (11), then the filter (12) can be arranged at the food liquid inlet (11*a*) of the food liquid tank (11) (FIG. 3).

The first conduit (4) can also comprise a further food liquid outlet (4*c*) from the first conduit (4) in order to dispense food liquid (FIG. 3).

Moreover, the automatic dispenser (1) can comprise a closure case (not shown) being shaped in order to allow the liquid food mixture to exit.

Referring to FIGS. 2 and 3, the automatic dispenser can comprise a valve (12) along the second conduct (5).

The invention claimed is:

1. An automatic dispenser for preparing and dispensing a liquid food mixture, comprising: a food concentrate tank; a pipeline comprising a first conduit comprising a food liquid inlet and a first food liquid outlet, and a second conduit comprising a food concentrate inlet, which is in fluid communication with the food concentrate tank, and a food concentrate outlet; the automatic dispenser being characterized in that it comprises: flow rate stabilization means arranged along the first conduit; a self-priming mixing pump comprising an inlet, which is in fluid communication with the first food liquid outlet of the first conduit and with the food concentrate outlet of the second conduit, and a liquid food mixture outlet; the self-priming mixing pump being designed for: suctioning the food concentrate from the food concentrate tank; creating a depression inside the self-priming mixing pump which is such as to mix, inside the same self-priming mixing pump, the food concentrate and the food liquid obtaining a liquid food mixture; allowing the pressurized outflow of the liquid food mixture from the liquid food mixture outlet.

2. The automatic dispenser according to claim 1, wherein the pipeline comprises a third conduit comprising a liquid food mixture inlet, which is in fluid communication with the liquid food mixture outlet of the self-priming mixing pump, and a liquid food mixture outlet.

3. The automatic dispenser according to claim 2, wherein the first conduit comprises a second food liquid outlet and wherein the pipeline comprises a fifth conduit comprising a food liquid inlet, which is in fluid communication with the second food liquid outlet of the first conduit, and a food liquid outlet; the third conduit comprising a food liquid inlet which is arranged between the relative liquid food mixture inlet and the relative liquid food mixture outlet, which food liquid inlet of the third conduit being in fluid communication with the food liquid outlet of the fifth conduit in order to expedite the outflow of the liquid food mixture from the liquid food mixture outlet of the third conduit.

4. The automatic dispenser according to claim 1, wherein the pipeline comprises a fourth conduit comprising a food liquid inlet, which is in fluid communication with the first conduit upstream of the flow rate stabilization means, and a food liquid outlet, which is in fluid communication with the first conduit downstream of the flow rate stabilization means; the automatic dispenser comprising flow rate adjusting means which are arranged along the fourth conduit and which are actuatable to adjust the flow rate of the food liquid exiting the first conduit.

5. The automatic dispenser according to claim 1, wherein the self-priming mixing pump is a self-priming pump with rotating compartments.

6. The automatic dispenser according to claim 1, wherein the food liquid inlet of the first conduit is in fluid communication with a water supply system.

7. The automatic dispenser according to claim 1, wherein the food liquid is water.

* * * * *